United States Patent [19]

Barlow

[11] 3,989,251

[45] Nov. 2, 1976

[54] MAGIC GAME

[75] Inventor: Gordon A. Barlow, Skokie, Ill.

[73] Assignee: Marvin Glass & Associates, Chicago, Ill.

[22] Filed: Apr. 18, 1975

[21] Appl. No.: 569,168

[52] U.S. Cl. ..... 273/134 AE; 46/242; 272/8 R; 273/1 M; 273/134 B; 273/134 D

[51] Int. Cl.[2] ..... A63F 3/00

[58] Field of Search ..... 46/242; 272/8, 9, 11, 272/21, 25; 273/134

[56] References Cited

UNITED STATES PATENTS

| | | | |
|---|---|---|---|
| 838,979 | 12/1906 | Goldin | 272/9 |
| 1,052,277 | 2/1913 | Robinson | 272/8 R |
| 2,580,305 | 12/1951 | Kremer | 272/8 R |
| 2,976,044 | 3/1961 | Corpening | 273/134 AD |
| 3,594,002 | 7/1971 | Glass et al. | 273/134 B |

FOREIGN PATENTS OR APPLICATIONS

| | | | |
|---|---|---|---|
| 1,315,091 | 12/1962 | France | 272/8 R |
| 245,857 | 1/1926 | United Kingdom | 272/25 |
| 1,239,755 | 7/1971 | United Kingdom | 273/134 AF |

*Primary Examiner*—Delbert B. Lowe
*Attorney, Agent, or Firm*—Coffee & Sweeney

[57] ABSTRACT

A board game apparatus including trick accessories based on a magic theme wherein the object is to amass the greatest amount of wealth in the form of simulated money. The game generally includes a gameboard having a playing surface thereon, a playing piece for each player of the game, simultated money, a track defining a playing piece path of travel on the playing surface, and a chance device for determining the advancement of the playing pieces along the track. The track has a plurality of stations including trick stations having indicia thereon representative of a magic trick which a player may attempt to perform after expending some of the simulated money. A player will receive a predetermined amount of simulated money upon the successful performance of one of the magic tricks. The magic tricks include a device for performing a levitation act, a device for performing a vanishing act, and a device for performing the feat of sawing a body in half. The game also includes a plurality or set of information cards which instruct the players to perform a variety of varying functions.

15 Claims, 12 Drawing Figures

Fig 1
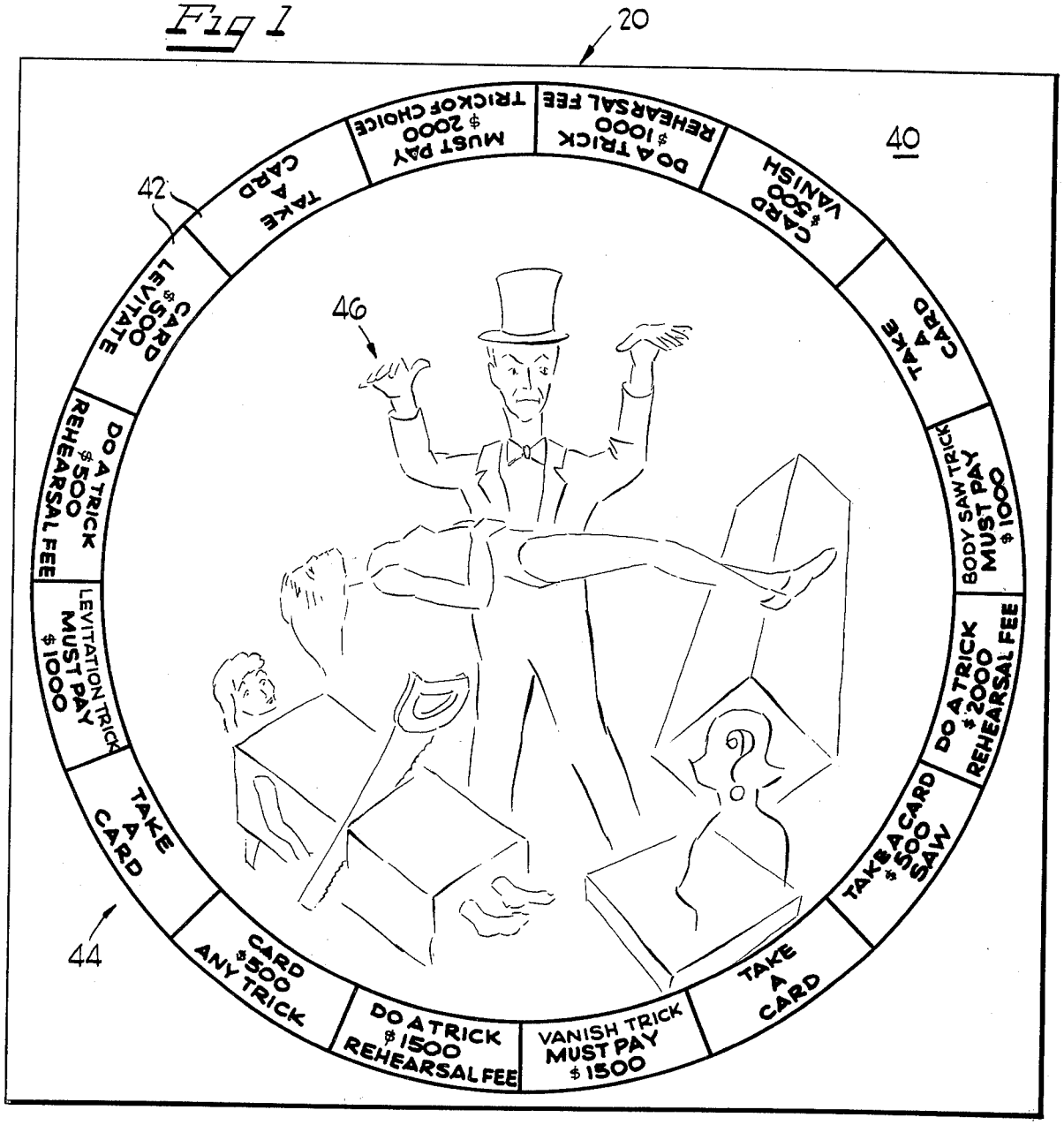
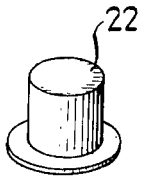
Fig 2
Fig 3
"BONUS" $1500
ONE BONUS MAY BE PLAYED BEFORE TRICK IS ATTEMPTED. IF TRICK DOES NOT WORK BONUS STAYS WITH TRICK.
50
24
DO ANY TRICK FREE
PLAY ON YOURSELF ON YOUR TURN. DO NOT PAY REHEARSAL FEE.
52
$500
$1000
26
Fig 4

Fig 6
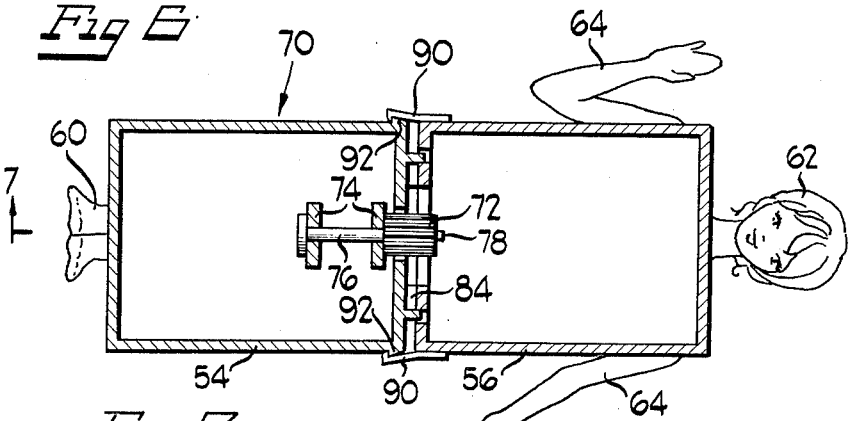
Fig 8
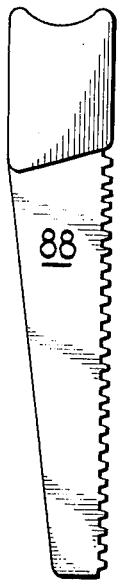
Fig 7
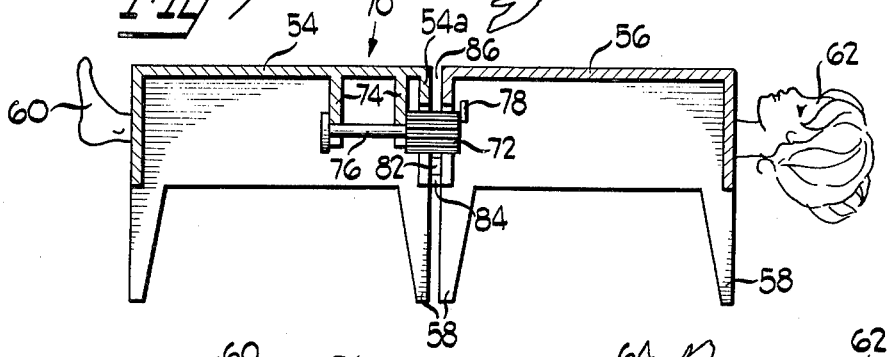
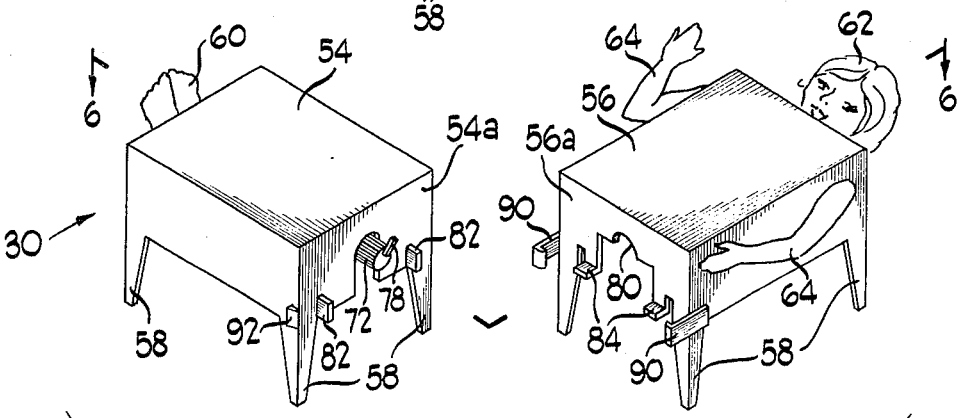
Fig 5
Fig 10
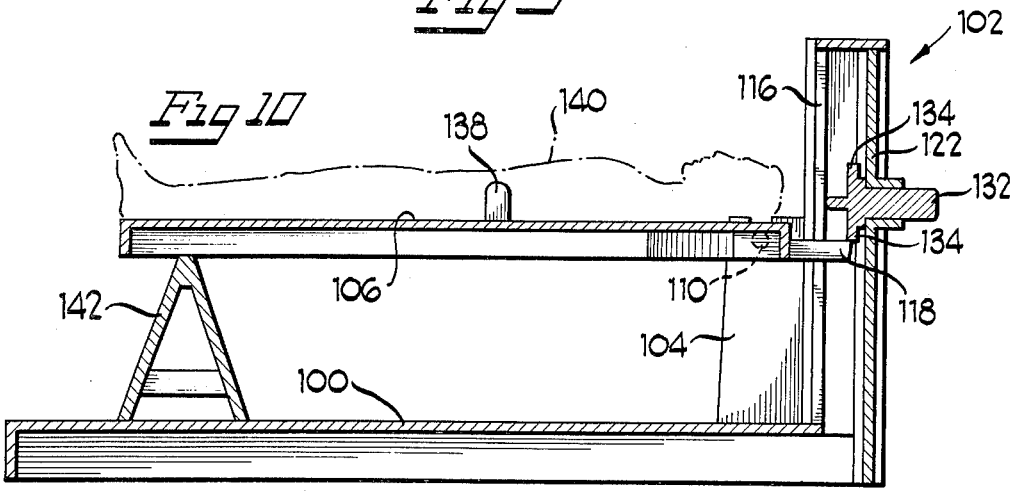

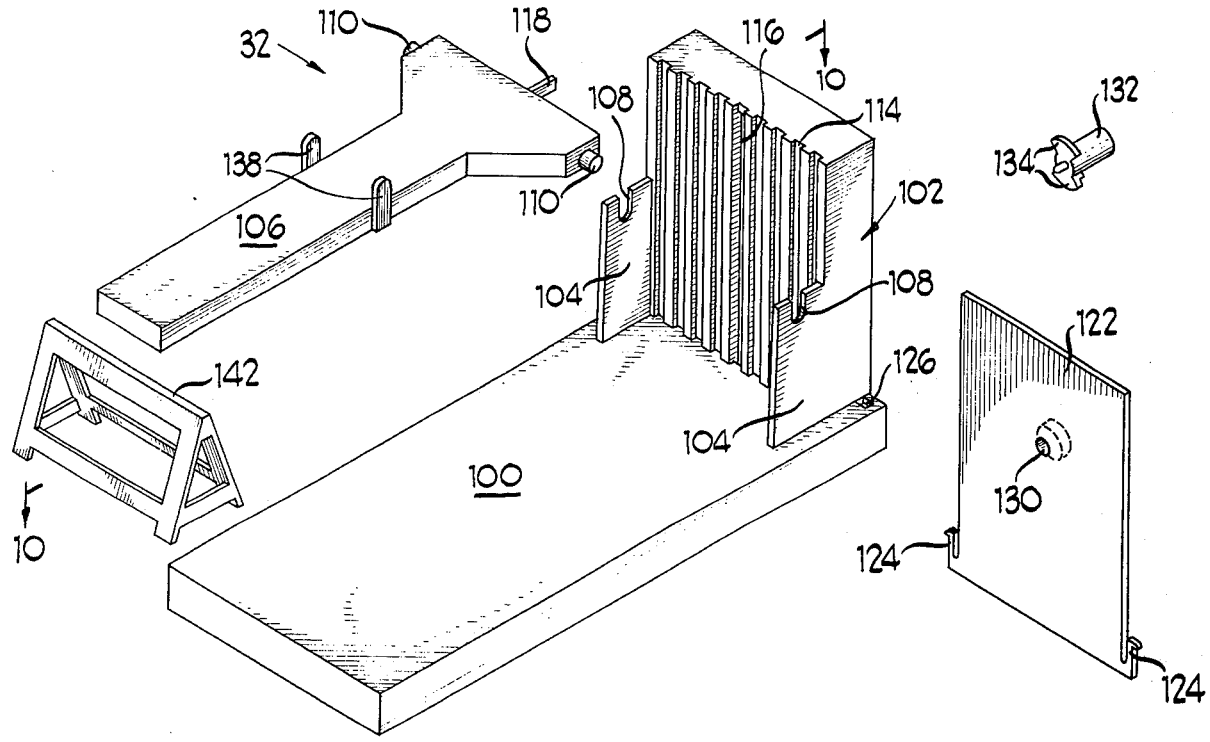
Fig 9
Fig 12
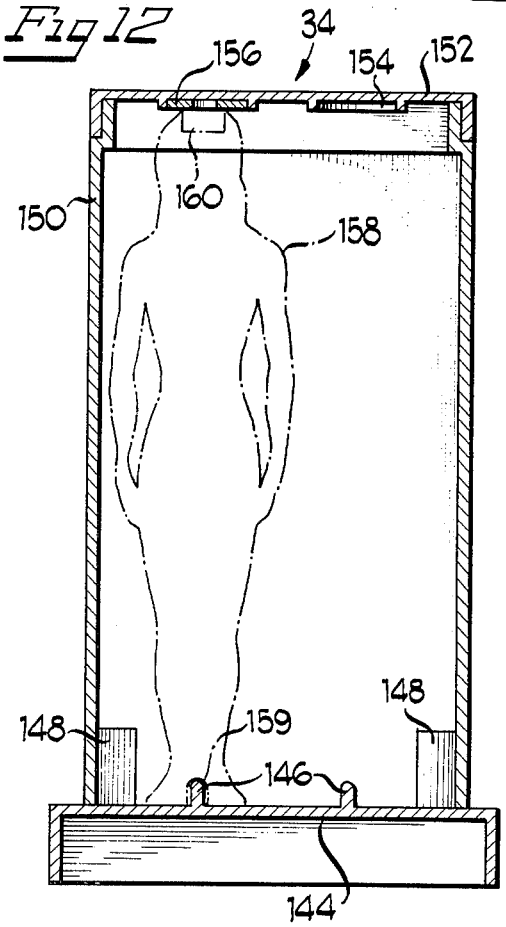
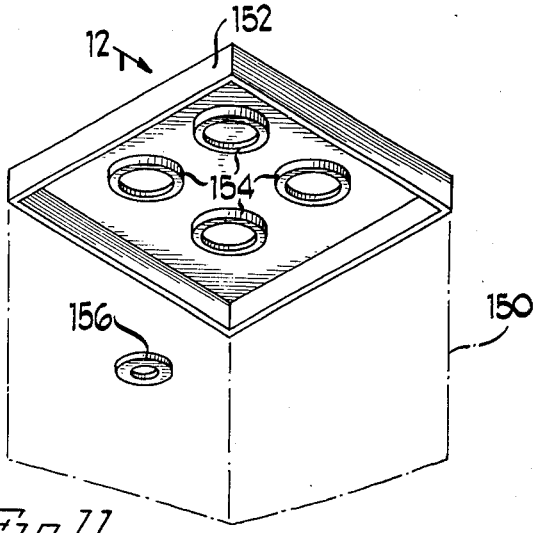
Fig 11
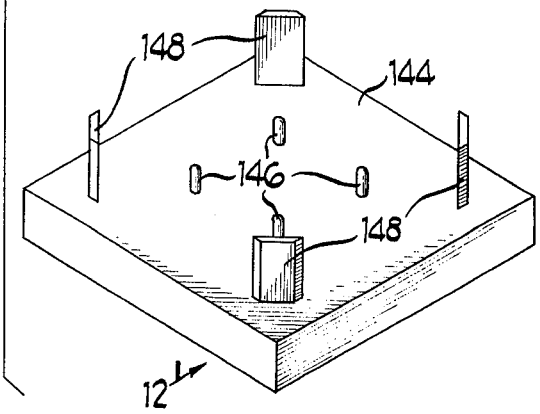

MAGIC GAME

BACKGROUND OF THE INVENTION

1. Field of the Invention

The present invention relates to board games and more particularly to a board game including trick accessories in which the object is to amass the greatest amount of wealth in the form of simulated money.

2. Brief Description of the Prior Art

Board games have enjoyed a great deal of popularity throughout the years. One form of board game which has been popular is the type in which the object is to accumulate wealth in the form of simulated money or the like. However, most of these board games have relied, for the most part, solely on an element of chance for determining the manner and amount of simulated money acquired by a player.

SUMMARY OF THE INVENTION

An object of the present invention is to provide a new and entertaining board game using a plurality of magic trick accessories correlated to stations on the board which the players of the game must perform in order to acquire wealth in the form of simulated money.

Other objects, features and advantages of the invention will be apparent from the following detailed description taken in connection with the accompanying drawings.

These and other objects of the invention are accomplished in one embodiment currently contemplated which provides for a gameboard having a playing surface thereon, a plurality of playing pieces, at least one for each player of the game, a plurality of stations on the playing board to form a track defining a playing piece path of travel, and a chance device for determining the advancement of the playing pieces along the track. In the preferred embodiment, there also are provided simulated money, a plurality or set of information cards, and a plurality of devices for performing several magic tricks. At least some of the stations and some of the information cards include indicia thereon instructing one of the players of the game to attempt to perform one of the magic tricks.

The magic trick devices or accessories include an apparatus for performing a levitation act, an apparatus for performing a vanishing act, and an apparatus for performing the illusion of sawing a body in two parts.

BRIEF DESCRIPTION OF THE DRAWINGS

FIG. 1 is a top plan view of the gameboard of the game apparatus embodying the concepts of the present invention;

FIG. 2 is a perspective view of one of the playing pieces of the board game apparatus of the present invention;

FIG. 3 is a top plan view of two of the plurality of information cards of the game apparatus of the present invention;

FIG. 4 is a top plan view of two of the simulated money pieces of the present invention;

FIG. 5 is a perspective view of a magic trick apparatus for performing the illusion of sawing a body in two parts, shown in its disconnected position;

FIG. 6 is a horizontal section, on an enlarged scale, of the body sawing trick apparatus taken generally along the line 6—6 of FIG. 5;

FIG. 7 is a vertical section of the body sawing trick apparatus, taken generally along the line 7—7 of FIG. 6;

FIG. 8 is a side elevational view of a saw for use with the magic trick apparatus of FIG. 5;

FIG. 9 is an exploded perspective view of a magic trick apparatus for performing the levitation act of the present invention;

FIG. 10 is a vertical section of the assembled magic trick apparatus of FIG. 9, taken generally along the line 10—10 of FIG. 9;

FIG. 11 is a fragmentary perspective view of a magic trick apparatus for performing a vanishing trick of the present invention; and FIG. 12 is a vertical section of the vanishing magic trick apparatus of FIG. 11, taken generally along the line 12—12 of FIG. 11.

DESCRIPTION OF THE PREFERRED EMBODIMENT

The board game apparatus of the present invention includes a gameboard, generally designated 20 (FIG. 1), a plurality of playing pieces 22 in the shape of miniature hats (FIG. 2), a set of instruction cards, generally designated 24 (FIG. 3), a plurality of simulated money 26 (FIG. 4), and a die (not shown) for use as a chance device. The game also includes a plurality of devices for use in performing magic tricks or illusions in accordance with the dictates of the rules of the game. The trick devices include an apparatus, generally designated 30 (FIGS. 5–8), for performing the illusion of sawing a body in two parts, a levitation apparatus, generally designated 32 (FIGS. 9 and 10), for performing the illusion of levitating a body (FIG. 9), and an apparatus, generally designated 34 (FIGS. 11 and 12), for performing the illusion of causing a body to vanish.

The gameboard 20 includes a playing surface 40 having indicia thereon representative of a plurality of stations 42. The stations 42 define a closed loop or path of travel, generally designated 44, for the playing pieces 22 during the play of the game. Additional indicia, generally designated 46, in the center of the path 44 depicts a magician performing the magic acts of levitating a body, sawing a body in two portions, and causing a figure to vanish.

The stations 42 each include indicia thereon representative of one of several events which may affect a player should his playing piece land on a particular station. Several of the stations 42 require a player to perform one of the magic tricks 30, 32 and 34, to be described in detail hereinafter, after expending a designated amount of simulated money 26, the "Rehearsal Fee." Several of the other stations 42 require a player whose playing piece 22 lands thereon to pay a particular amount of simulated money 26 to "do a trick" as designated by the indicia on the station. The remaining stations 42 instruct a player to take one of the instruction cards 24 from the set of instruction cards and follow or perform the message indicated thereon. Additionally, some of the card stations also permit the player to perform or attempt to perform one or any of the magic tricks.

The instruction cards 24 each carry indicia which dictate what a player must do or what the card 24 may be used for. For example, at the top of FIG. 3, a bonus card 50 permits the player to use this card to increase the value of the successful performance of a trick of his choice. This card 50 may be used at any time according to the dictates of the rules of the game. A "free card" 52, at the bottom of FIG. 3, can be used by a player in his attempt to perform one of the magic tricks without paying the required rehearsal fee, as represented by the indicia thereon. Additionally, a "special performance" instruction card (not shown) may be provided to permit a player to wager with another player any amount from $500 to $5,000 to perform a trick. The winner will receive all of the money but if both fail to perform the trick successfully the additional money remains with the trick. Another information card (not shown) designated "take a vacation" permits a player to preempt another player from performing a trick after he has already paid the rehearsal fee and permits the player to attempt to perform the trick himself without a fee.

A plurality of additional information cards 24 also are provided and need not be shown in the drawings. The cards generally give a player who has taken the cards an advantage or disadvantage over his opponents. An example of the advantage cards are ones which permit a player to attempt to perform a trick after another player has failed to perform the trick without paying the required rehearsal fee. Another one of the advantage cards permits a player to select one of the information cards which another player may be holding and use it to his advantage. The disadvantage cards are similar except that they lessen the chances of winning for a particular player in some respect. For example, one of the disadvantage cards requires a player to pay a double rehearsal fee before he attempts to perform a trick. Another of the disadvantage cards requires a player who has successfully performed a trick to do it again in order to receive the money associated therewith. These two enumerated disadvantage cards usually are acquired by one of the players of the game and played or applied against his opponents during the play of the game.

The devices used for performing or attempting to perform the magic tricks as discussed above, are shown in FIGS. 5–12. FIG. 5 shows the apparatus used for performing the illusion of sawing a body into two parts if the trick has been successfully performed by a player of the game. The apparatus 30 includes two rectangular housing portions 54 and 56 each of which are supported on a table or the like by a plurality of legs 58. The extremities of a figure toy extend from the walls of the housing portions 54 and 56 and include a pair of feet 60 at one end of the housing portion 54 and a head 62 and a pair of arms 64 extending from the other end of the housing portion 56 to give the impression that a body or figure toy is positioned within the housing.

The two portions 54 and 56 of the housing are connected together by a selectively actuatable locking means, generally designated 70 (FIGS. 6 and 7). The locking means 70 includes a pinion gear 72 which is rotatably mounted within the housing 54 by a pair of depending tabs 74 journalling a pinion shaft 76. The pinion gear 72 extends through a wall 54*a* of the housing portion 54 and, when the housings 54 and 56 are adjacent one another, into a complementary wall 56*a* of the housing portion 56. The pinion gear 72 includes a single tab 78 which will engage the wall 56*a* of the housing 56 in certain positions to prevent the separation of the housing portions 54 and 56. Note that the wall 56*a* of the housing portion 56 includes a semi-circular cutout 80 which permits a clearance fit for the pinion gear 72 but catches the tab 78 therebehind to prevent separation of the housing portions. Thus the housing portions can only be separated, signifying a successful performance of the trick, when the tab 78 is directed generally downwardly to clear the aperture 80. When the housing portions 54 and 56 are placed adjacent one another as shown in FIGS. 6 and 7, a pair of vertical flanges 82 on the wall 54*a* and a similar pair of horizontal flanges 84 on the wall 56*a* maintain the housing portions in a spaced apart relationship as shown in FIGS. 6 and 7 to provide a groove 86 above the pinion 72. A gear rack 88 (FIG. 8) is provided in the shape of a miniature saw to engage the rack 72 through the slot 86 to permit selective manual rotation of the pinion gear 72.

Thus, a player of the game attempts to "saw the body in two" by rotating the pinion gear with the rack or saw 88 moving back-and-forth in an attempt to align the tab 78 so that the housing portions 54 and 56 can be separated. Of course, it is not possible for the player to see the position of the tab 78 and thus this attempt adds an element of chance to the game apparatus. Detent means in the form of a pair of leaf springs 90 on the housing portion 56 and notches 92 on the housing portion 54 cooperate to maintain the housing portions 54 and 56 together even when the tab 78 is downwardly aligned. This prevents a player from being able to "feel" the position of the tab 78 during its rotation to thus provide an element of pure probability. After stopping movement of the saw 88, the housing portions may or may not be separated by a player by pulling outwardly on the leaf springs 90 to see if he has successfully performed the trick.

The levitation device 32 for performing the magic trick of levitating a body is shown in FIGS. 9 and 10. The device 32 includes a base or platform portion 100 having a vertically upstanding wall portion, generally designated 102, at one end thereof. The vertical wall portion 102 includes a pair of longitudinally directed vertical flanges 104 for supporting a pivotally mounted platform 106. Each flange 104 includes a U-shaped journal 108 for engagement with a horizontal pin 110 on each side of the platform 106 to support the platform so that it can pivot. The lefthand face of the vertical wall 102, as shown in FIG. 9, includes a plurality of vertical grooves 114 which serve to disguise a single slot 116 in the center thereof. A horizontal tab 118 on the platform 106 is inserted through the slot 116 when the platform is mounted with pins 110 in the journals 108. The vertical wall 102 includes a closing wall 122 which is shown removed in FIG. 9. The wall 122 includes a pair of tabs 124 on its lowermost ends for engagement with a pair of slots 126 provided in the base 100 for mounting. An aperture or journal 130 is provided approximately in the center of the wall 122 for mounting a rotatable cam 132. The cam 132 includes two opposed tab portions 134 which, when mounted in the journal 130, may be in an interference path of travel with the tab 118. With reference to FIG. 10, the downwardly extending tab 134 engages the tab 118 to secure the platform 106 in the position as shown in FIG. 10. During the attempt to perform this trick, the player places a figure toy 140 between a pair of vertical tabs 138 on the platform 106 while the small "horse" or brace 142 supports the platform 106 in a horizontal position. The player then rotates the cam 132 in an attempt to align one of the tabs 134 with the tab 118 on the platform. The player then removes the brace 142, and if the platform 106 remains in the horizontal position, he has successfully performed the levitation trick. However, if neither of the tabs 134 engage the tab 118, the platform 106 will pivot downwardly to thereby indicate a failure as the figure toy slides down the platform.

An apparatus for performing a third magic trick is shown in FIGS. 11 and 12. This apparatus 34 permits the players of the game to perform the illusion of causing a figure toy to vanish. The apparatus includes a generally rectangular base 144 which includes a plurality of upstanding posts 146 and a plurality of upstanding flanges 148. The apparatus 34 includes a generally rectangular tubular housing portion 150 and a roof portion 152 mounted thereon. The roof portion 152 is seen in the top of FIG. 11 to include a plurality of depending circular flanges or rings 154. The rings 154 are positioned generally so as to be directly above the pins 146 when the housing 150 is placed over the flanges 148 as shown in FIG. 12. One of the rings 154 is fitted with a steel washer 156 which may be removed and placed in any of the other rings and maintained there by a force fit about its circumference.

To perform the vanishing act, a player of the game places a figure toy 158 having a bottom recess 159 over one of the pins 146 which is supported in a generally vertical orientation on the base 144. The figure toy includes a small magnet 160 at the top of the head portion so that if the housing 150 and roof 152 are properly placed, without a player looking into the housing, on the base 144 the magnet will be in alignment with one of the rings 154. If the washer 156 is positioned within the ring 154 above the magnet 160 in the head of the figure toy 158, lifting of the housing off of the base 154 will cause the figure toy to remain within the housing and thus appear to vanish. If, however, the washer 156 is not in the ring 154 above the figure toy's head, the figure toy will remain on the base and the player will fail to perform the vanishing act.

In one scheme of play of the game, two to four players compete in an attempt to accumulate the largest amount of simulated money. Each player may begin by placing his playing piece 22 on one of the stations 42 nearest him and move around the path of travel 44 according to the roll of the die. Each of the players receive a predetermined amount of simulated money 26 from the "bank" and another predetermined amount of money is placed with each trick 30, 32 and 34. Each time a player moves his playing piece 22 to another station he will follow the instructions on that station. As previously described, the trick stations require the player to expend some of his simulated money 26 in order to attempt to perform one of the magic tricks 30, 32 or 34. If the player fails to perform the trick, the expended simulated money stays with the trick to be awarded to the first subsequent player to perform the trick. Some of the stations require a player whose playing piece lands thereon to perform a specific trick while some of the other stations 42 permit the player to attempt to perform the trick of his choice. Thus, if a trick has been attempted but not performed by several previous players, a large amount of money will have been built up with regard to that trick and a player is wise to attempt to perform that trick so as to receive a large amount of simulated money. Some of the other stations require a player merely to take a card or to take a card and do a trick. Additionally, some of the cards carry specific instructions for a player and may require a player also to perform or attempt to perform a trick. In one scheme of play, the stations having the indicia "must pay" have been used to require a player to pay the amount of money indicated but then eliminate him from attempting that trick. The players may buy and sell or trade cards between themselves at any time during the play of the game. The game is over when one of the players has lost all of his simulated money or when the initial amount of money provided is completely expended.

The foregoing detailed description has been given for clearness of understanding only and no unnecessary limitations should be understood therefrom as some modifications will be obvious to those skilled in the art.

I claim:

1. A board game apparatus, comprising:

a gameboard having a playing surface thereon;

a plurality of playing pieces;

a plurality of stations on the gameboard defining a playing piece path of travel, including trick stations having indicia thereon representative of a magic trick that a player may attempt to perform should his playing piece land on that particular trick station;

a plurality of randomly operable magic trick devices corresponding to the magic tricks represented on said trick stations;

simulated money for each player of the game, said trick stations including indicia thereon which require a player to expend a predetermined amount of simulated money in order to attempt to perform one of the magic tricks by using said magic trick devices, said money being accumulated with each magic trick to be awarded to a player who first successfully performs the respective magic trick; and means for determining how many stations a particular playing piece is to be advanced by a player along said path.

2. The board game apparatus of claim 1 wherein one of said magic trick devices includes player operable means for attempting to simulate the levitation of a figure toy or other article.

3. A board game apparatus, comprising:

a gameboard having a playing surface thereon;

a plurality of playing pieces;

a plurality of stations on the gameboard defining a playing piece path of travel, including trick stations having indicia thereon representative of a magic trick that a player may attempt to perform should his playing piece land on that particular station;

at least one magic trick device comprising a levitation trick including a base having a generally upstanding wall portion, a platform pivotally mounted to said wall portion for supporting a figure toy or the like, said platform being movable between a generally horizontal position and a canted position, and manually engageable randomly operable locking means associated with said platform to maintain the platform in a horizontal position in response to engagement of said locking means and for permitting the platform to move to its canted position in response to disengagement of said locking means; and means for determining how many stations a particular playing piece is to be advanced by a player along said path.

4. The board game apparatus of claim 3 including support means engageable with the free end of said platform for maintaining the platform in the horizontal position during selective manual operation of said locking means.

5. The board game apparatus of claim 1 wherein one of said magic trick devices includes player operable means for attempting to perform the illusion of sawing a body into two parts.

6. A board game apparatus, comprising:

a gameboard having a playing surface thereon;

a plurality of playing pieces;

a plurality of stations on the gameboard defining a playing piece path of travel, including trick stations having indicia thereon representative of a magic trick that a player may attempt to perform should his playing piece land on that particular station;

at least one magic trick device including a housing having a first portion and a second portion, said first and second housing portions being positionable to define a housing apparently containing a figure toy, a manually engageable randomly operable locking means for maintaining said first and second portions in said position as a unitary member when the locking means is in an engaged position and for permitting separation of said first and second portions when the locking means is in a disengaged position to perform the illusion of dividing the apparent figure toy into two parts; and means for determining how many stations a particular playing piece is to be advanced by a player along said path.

7. The board game apparatus of claim 6 wherein said first and second housing portions have appendages of the figure toy extending outwardly therefrom, whereby movement of said locking means to said disengaged position presents the illusion of dividing the figure toy into two portions.

8. The board game apparatus of claim 7 wherein said locking means includes a rotatable member mounted to a rotatable pinion gear and includes a manually operable gear rack for engaging the pinion gear to rotate said member.

9. The board game apparatus of claim 8 wherein said gear rack is in the form and shape of a saw to perform the illusion of sawing the apparent figure toy into two parts.

10. The board game apparatus of claim 1 wherein one of said magic trick devices includes player operable means for attempting to perform the illusion of causing a figure toy or other article to vanish.

11. A board game apparatus, comprising:

a gameboard having a playing surface thereon;

a plurality of playing pieces;

a plurality of stations on the gameboard defining a playing piece path of travel, including trick stations having indicia thereon representative of a magic trick that a player may attempt to perform should his playing piece land on that particular trick station;

at least one magic trick device for performing the illusion of causing a figure toy to vanish including a base portion, a figure toy selectively positionable at a plurality of positions on said base portion, and a housing for mounting on the base portion over the figure toy, said housing including randomly engageable locking means engageable with said figure toy for carrying the figure toy upwardly with said housing when the housing is removed from the base but only after the figure toy is placed in the base portion in position to engage the locking means; and means for determining how many stations a particular playing piece is to be advanced by a player along said path.

12. The board game apparatus of claim 11 wherein said locking means includes magnetic means in the head of said figure toy and in the top of said housing for engagement for carrying said figure toy with the housing when the figure toy is properly positioned.

13. The board game apparatus of claim 1 including a set of instruction cards, having indicia thereon representative of one of many advantages or disadvantages that may affect a player, said path of travel including some stations having indicia thereon instructing a player whose playing piece lands thereon to take an instruction card from the set of instruction cards.

14. The board game apparatus of claim 13 wherein at least some of the instruction cards have indicia thereon requiring a player who has successfully performed a trick to attempt to perform the trick again.

15. The board game apparatus of claim 13 wherein some of said instruction cards have indicia thereon permitting another player to attempt to perform a magic trick subsequent to first player who has failed to perform the magic trick.

* * * * *